US005400566A

United States Patent [19]

Ghini et al.

[11] Patent Number: 5,400,566

[45] Date of Patent: Mar. 28, 1995

[54] POCKET ELEMENT FOR THE PACKING WHEEL OF A CIGARETTE PACKING MACHINE

[75] Inventors: Marco Ghini, Lazzaro di Savena; Fulvio Boldrini, Ferrara; Antonio Gamberini, Bologna, all of Italy

[73] Assignee: G.D Societa' per Azioni, Bologna, Italy

[21] Appl. No.: 29,446

[22] Filed: Mar. 11, 1993

[30] Foreign Application Priority Data

Mar. 13, 1992 [IT] Italy ..... B092A0086

[51] Int. Cl.[6] ..... B65B 7/00; B65B 19/22

[52] U.S. Cl. ..... 53/387.2; 53/234

[58] Field of Search ..... 53/233, 234, 387.1, 53/387.2, 387.3, 387.4; 198/803.3, 803.8, 470.1, 478.1

[56] References Cited

U.S. PATENT DOCUMENTS

| | | | |
|---|---|---|---|
| 4,208,854 | 6/1980 | Seragnoli | 53/234 X |
| 4,559,758 | 12/1985 | Gamberini | 53/234 |
| 4,843,800 | 7/1989 | Focke | 53/387.3 X |
| 4,981,006 | 1/1991 | Caenazzo et al. | 53/387.3 |

FOREIGN PATENT DOCUMENTS

| | | |
|---|---|---|
| 45105 | 5/1951 | Czechoslovakia . |
| 2214482A | 6/1989 | United Kingdom . |
| 2225564A | 6/1990 | United Kingdom . |

*Primary Examiner*—John Sipos
*Assistant Examiner*—Gene Kim
*Attorney, Agent, or Firm*—Klauber & Jackson

[57] ABSTRACT

A pocket element for a packing wheel for packing groups of cigarettes in rigid packets with a hinged lid; each packet being formed by folding a precut blank; and the pocket element presenting a seat having a pair of locating elements, each having an oblique surface for supporting respective edges of a respective pair of end tabs of the blank defining a small longitudinal wall of the lid of a respective packet.

6 Claims, 2 Drawing Sheets

POCKET ELEMENT FOR THE PACKING WHEEL OF A CIGARETTE PACKING MACHINE

BACKGROUND OF THE INVENTION

The present invention relates to a pocket element for the packing wheel of a cigarette packing machine.

Italian Patent Application N. 3681A/88, to which full reference is made herein in the interest of full disclosure, relates to a packing wheel comprising a number of pocket elements, each having a seat for receiving, at a loading station, a flat precut blank of a rigid hinged-lid cigarette packet, and a preformed group of cigarettes for packing.

The packets are formed by feeding each pocket element along a folding path on which a first portion of the blank is folded to define the package enclosing the group, and a second portion of the blank is folded to define the hinged lid. More specifically, the second portion comprises two pairs of lateral end tabs defined laterally by an oblique edge, and the tabs in each pair are folded squarely one on top of the other and joined via the interposition of adhesive material, so as to define a respective small lateral wall of the lid.

Owing to the shape memory of the blank, the tabs in each pair, initially superimposed with the oblique edges arranged perfectly one on top of the other, tend to slip in relation to each other, especially pending drying of the adhesive material, thus jeopardizing the quality of the finished product.

SUMMARY OF THE INVENTION

It is an object of the present invention to provide a straightforward pocket element designed to overcome the aforementioned drawback.

According to the present invention, there is provided a pocket element for the packing wheel of a cigarette packing machine, the pocket element defining a seat for receiving a rigid packet comprising a package and a hinged lid, and formed by folding a blank about a preformed group of cigarettes; the lid presenting two small lateral walls, each having a free edge facing the package and defined by the coincident edges of two superimposed, mutually connected tabs of said blank; characterized by the fact that said seat presents two lateral shoulders, each constituting a support for said edges of a respective said pair of tabs.

Said seat of the pocket element described above preferably presents two lateral surfaces, and a bottom surface connecting said two lateral surfaces; each said shoulder being formed on a respective said lateral surface, and sloping towards said bottom surface and towards the longitudinal end of the seat facing the shoulder.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
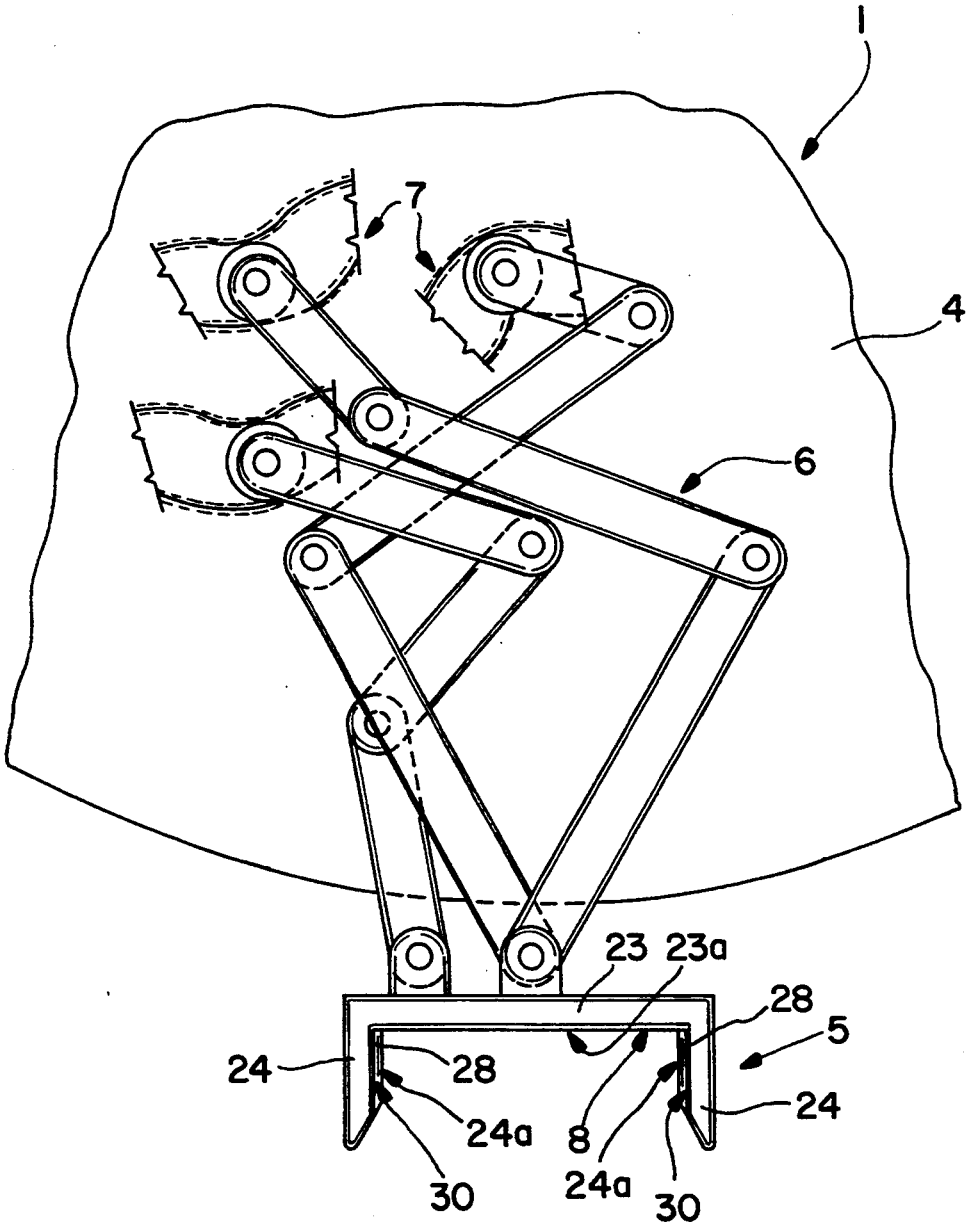
FIG. 1 shows a preferred embodiment of the pocket element according to the present invention, fitted to the packing wheel of a packing machine.

Number 1 in FIG. 1 indicates a packing wheel (shown only partially) of a packing machine (not shown) for packing cigarettes in rigid packets 2 with a hinged lid 3. Packing wheel 1, a full description of which is given in Italian Patent Application N. 3681A/88, is mounted for rotation about a shaft (not shown), and comprises a fixed central portion 4, and a number of pocket elements 5 (only one shown in FIG. 1), each connected to central portion 4 by a known articulated support indicated as a whole by 6 and controlled by a cam device 7.

Figure 2:
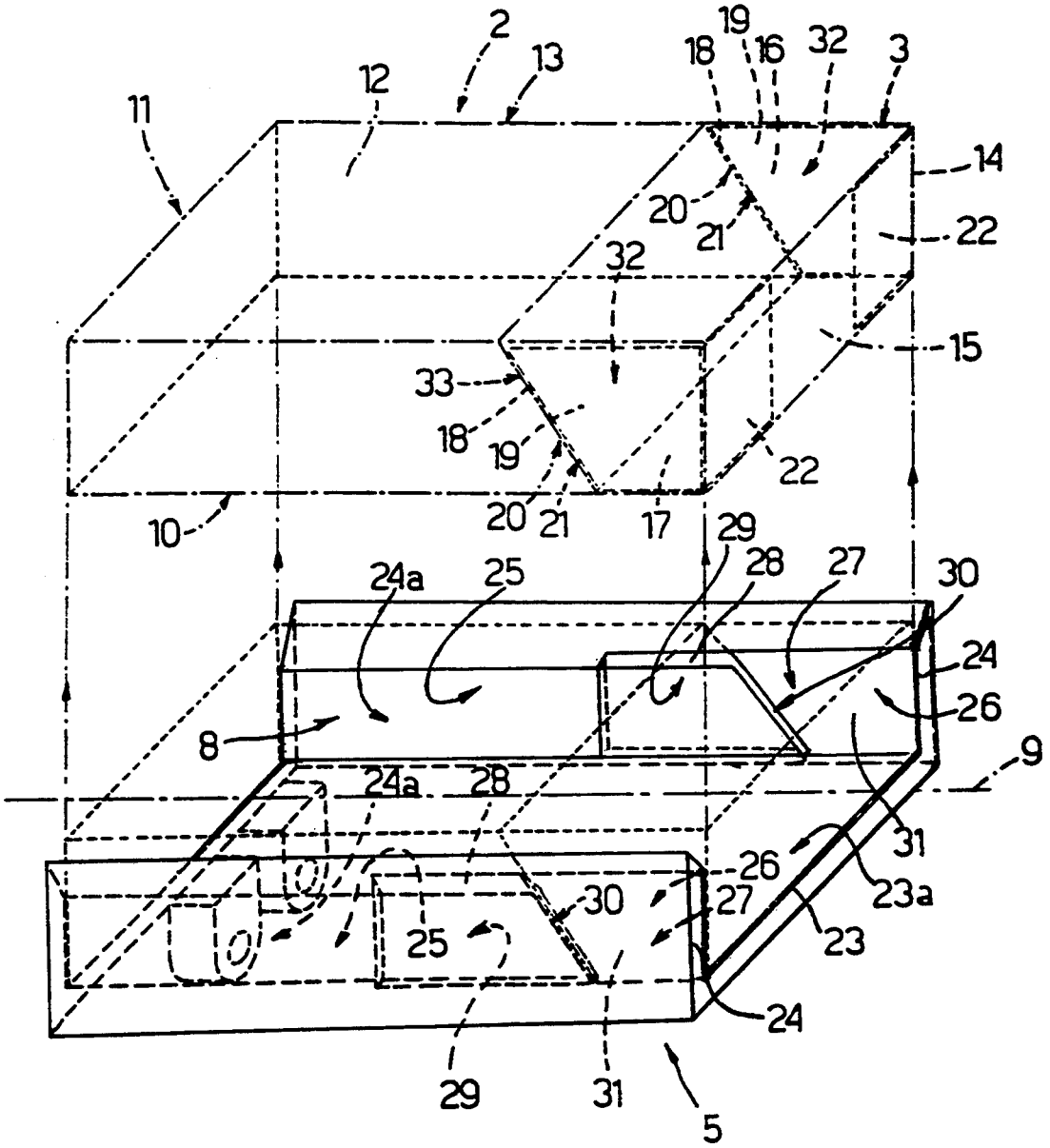
FIG. 2 shows an enlarged view in perspective of a detail in FIG. 1.

With reference to FIGS. 1 and 2, each element 5 is substantially U-shaped, and defines a seat 8 having a longitudinal axis 9 parallel to the shaft (not shown) of wheel 1, and designed to receive both an intermediate U-folded portion 10 of a precut blank 11 of a respective packet 2, and a preformed group of cigarettes (not shown) mating with U-shaped portion 10 and the longitudinal axis of which coincides with axis 9. In addition to U-shaped portion 10, each blank 11 also comprises a portion 12, which is folded about the group of cigarettes (not shown) to define, together with portion 10, a package 13 in which the group is housed; and a portion 14, which is folded to define the lid 3 of package 13.

Portion 14 is divided by a pair of transverse yield lines into an intermediate panel 15, and two lateral panels 16 and 17 on either side of panel 15. Each of panels 16 and 17 presents a pair of end tabs 18 and 19 extending on opposite sides of respective panel 16, 17, and each substantially in the form of a rectangular trapezium. More specifically, tabs 18 are connected by the longer side to panel 16, and present a respective oblique edge 20; while tabs 19 are connected by the shorter side to panel 17, and present a respective oblique edge 21 substantially parallel to edge 20 of respective tab 18. Each tab 19 also presents a rectangular appendix 22 integral with a straight side of tab 19 and which, in use, is arranged contacting the inner surface of panel 15.

Again with reference to FIGS. 1 and 2, each element 5 comprises a bottom wall 23 having a surface **23*a* constituting the bottom surface of seat 8; and two lateral walls 24 parallel to each other and to axis 9, extending from the opposite ends of and perpendicular to wall 23, and defined at the free end by an inclined lead-in surface. Inwards of seat S, walls 24 present respective inner surfaces 24*a* having a first portion defined by respective flat surfaces 25 parallel to each other and separated by a distance approximately equal to but no greater than the width of packets 2; and a remaining portion defined by respective recesses 26, each defined by a bottom surface 27 parallel to respective surface 25, and each housing a respective longitudinal locating element 28. More specifically, surfaces 27 are separated by a distance approximately equal to but no smaller than the width of packets 2**.

Each element 28, substantially in the form of a rectangular trapezium, is defined, inwards of seat 8, by a surface 29 parallel to and coplanar with respective surface 25, and axially, towards the axial end of seat 8 facing element 28, by a surface 30 sloping towards surface **23*a* and the end of seat 8, and forming with wall 23 an angle substantially equal to the angle formed by edges 20 and 21 of tabs 18 and 19** with a transverse yield line.

Again with reference to FIG. 2, each element 28 engages only part of respective recess 26, so as to leave a portion 31 of respective bottom surface 27 clear. Each portion 31 presents substantially the same shape and transverse dimensions as lateral wall 32 of lid 3 defined by a respective pair of tabs 18 and 19 connected one on top of the other so that respective edges 20 and 21 coincide and define a free oblique edge 33 of wall 32 facing package 13.

In actual use, as blank 11 is folded about a respective group of cigarettes (not shown), package 13 is subjected, inside seat 8, to a small amount of transverse pressure in contact with each pair of surfaces 25, 29, while walls 32 of lid 3 project slightly outwards in relation to the respective lateral walls of package 13, and are each positioned with oblique edge 33 contacting respective surface 30, which constitutes a shoulder for supporting oblique edges 20 and 21 of respective tabs 18 and 19, and so maintaining said two edges perfectly superimposed for as long as it takes for the adhesive material between tabs 18 and 19 to set.

Surfaces 30 may of course be formed directly on respective walls 24 with no need for locating elements 28, which provide solely for accommodating different formats.

We claim:

1. A pocket element (5) for the packing wheel (1) of a cigarette packing machine, said pocket element (5) comprising a seat (8) for receiving a package (13) having a hinged lid (3), said package (13) being formed by folding a blank (11) about a preformed group of cigarettes, said hinged lid (3) having two lateral walls (32), each said lateral wall (32) having a free edge (33) facing said package (13) that is defined by the coincident edges (20, 21) of two superimposed, mutually connected tabs (18, 19) of said blank (11), said seat (8) having two lateral shoulders (30) within the seat, each said lateral shoulder (30)protruding into the seat to communicate with said coincident edges (20, 21) for constituting a means for locating and supporting said coincident edges (20, 21) of said tabs (18, 19) of said blank (11) within said seat (8).

2. The pocket element (5) as defined in claim 1, wherein said seat (8) presents two lateral surfaces (24*a*), each said lateral surface (24*a*) being defined by a first lateral seat surface (25, 29) and a second lateral seat surface (27) which are parallel to each other and are connected by a respective said lateral shoulder (30).

3. The pocket element (5) as defined in claim 2, wherein each said lateral surface (24*a*) presents a recess (26), each said recess (26) having a bottom surface that is defined by a respective said second lateral seat surface (27).

4. The pocket element (5) as defined in claim 3, further comprising two locating elements (28), each said locating element (28) being housed inside a respective said recess (26), each said locating element (28) having a first lateral element surface (29) defining part of a respective said first lateral seat surface (25, 29), each said locating element (28) having a second lateral element surface (30) defining a respective said lateral shoulder (30).

5. The pocket element (5) as defined in claim 2, wherein said first lateral seat surface (25, 29) of each said lateral surface (24*a*) are separated by a distance approximately equal to but no greater than the width of said package (13), and wherein said second lateral seat surface (27) of each said lateral surface (24*a*) are separated by a distance approximately equal to but no smaller than the width of said package (13).

6. The pocket element (5) as defined in claim 1, wherein said seat (8) presents two lateral surfaces (24*a*) and a bottom surface (23*a*) connecting said two lateral surfaces (24*a*), wherein each said lateral shoulder (30) is formed on a respective said lateral surface (24*a*) with each said lateral shoulder (30) sloping towards said bottom surface (23*a*) and towards a longitudinal end of said seat (8).

* * * * *